US012590261B2

(12) United States Patent
Fallgatter et al.

(10) Patent No.: US 12,590,261 B2
(45) Date of Patent: Mar. 31, 2026

(54) PORTABLE DRY RECREATIONAL SLIDE

(71) Applicant: GoSlide LLC, Everett, WA (US)

(72) Inventors: Kiva C. Fallgatter, Everett, WA (US); James C. Fallgatter, Ridgecrest, CA (US)

(73) Assignee: GoSlide LLC, Everett, WA (US)

( * ) Notice: Subject to any disclaimer, the term of this patent is extended or adjusted under 35 U.S.C. 154(b) by 682 days.

(21) Appl. No.: 17/972,540

(22) Filed: Oct. 24, 2022

(65) Prior Publication Data

US 2023/0129814 A1 Apr. 27, 2023

Related U.S. Application Data

(60) Provisional application No. 63/262,969, filed on Oct. 24, 2021.

(51) Int. Cl.

| | |
|---|---|
| ***C10M 107/50*** | (2006.01) |
| ***A63G 21/00*** | (2006.01) |
| ***A63G 21/02*** | (2006.01) |
| ***D06M 15/643*** | (2006.01) |

(52) U.S. Cl.

CPC ..... *C10M 107/50* (2013.01); *A63G 21/00* (2013.01); *A63G 21/02* (2013.01); *D06M 15/643* (2013.01); *A63G 2200/00* (2013.01); *C10M 2229/025* (2013.01)

(58) Field of Classification Search

CPC ..... A63G 21/00; A63G 21/02; C10M 107/50; C10M 2229/025; C10N 2050/025; D06M 15/643; D06M 2101/20; D06M 2101/32; D06M 2101/34; D06M 2200/40; D06N 2203/042; D06N 2203/061; D06N 2203/065; D06N 2209/108; D06N 3/0006; D06N 3/0011; D06N 3/0034; D06N 3/0036; D06N 3/0038; D06N 3/128

USPC ..... 472/116

See application file for complete search history.

(56) References Cited

U.S. PATENT DOCUMENTS

| | | | | |
|---|---|---|---|---|
| 2,982,547 A | | 5/1961 | Carrier | |
| 3,497,211 A | | 2/1970 | Nagin | |
| 5,246,401 A | * | 9/1993 | Boatwright | A63G 21/00 280/18 |
| 5,590,420 A | | 1/1997 | Gunn | |
| D382,619 S | | 8/1997 | Peterson | |

(Continued)

FOREIGN PATENT DOCUMENTS

WO 2007012852 A1 2/2007

OTHER PUBLICATIONS

International Search Report and Written Opinion on corresponding PCT application (PCT/US2022/047621) from International Searching Authority (US) dated Apr. 17, 2023.

*Primary Examiner* — Laura K Tso

(74) *Attorney, Agent, or Firm* — FisherBroyles, LLP; Glen L Nuttall

(57) ABSTRACT

A portable dry recreational slide is configured to be easily carried by a single person when in a compacted state and expanded into a deployed state in a remote location as desired. The dry recreational slide, when deployed, is elongated and includes a low-friction sliding surface upon which a rider may slide without application of water, oil, soap or any other temporary lubricant. The dry slide comprises a slide body having a lightweight, flexible substrate coated with a low-friction material.

16 Claims, 4 Drawing Sheets

(56) References Cited

U.S. PATENT DOCUMENTS

| | | | | |
|---|---|---|---|---|
| 5,893,570 | A * | 4/1999 | Kehrmann | B62B 15/00 280/18.1 |
| 6,142,879 | A | 11/2000 | Phillips | |
| 6,312,341 | B1 | 11/2001 | Healy | |
| 7,896,778 | B1 | 3/2011 | Phillips | |
| 8,661,578 | B2 | 3/2014 | Judge | |
| 9,446,323 | B2 | 9/2016 | Goldreyer | |
| 9,901,836 | B1 * | 2/2018 | Moreland | B05B 15/62 |
| D867,509 | S | 11/2019 | Peterson et al. | |
| 2023/0348076 | A1 * | 11/2023 | Sivaraman | D06N 3/0088 |
| 2024/0181356 | A1 * | 6/2024 | Schmit | A63G 21/02 |

* cited by examiner

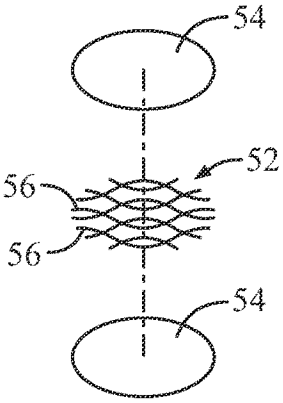
FIG. 3
FIG. 2
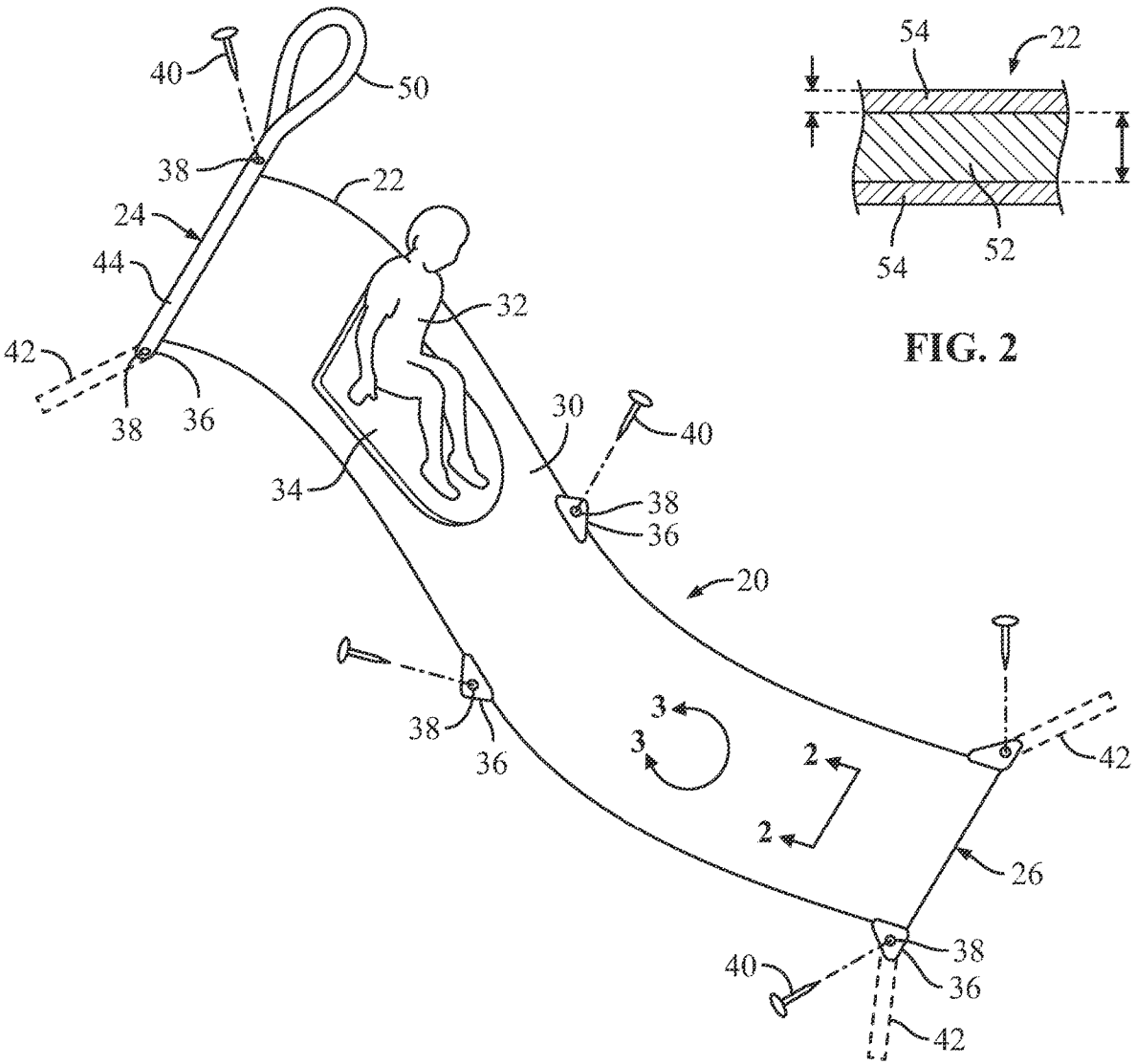
FIG. 1

PORTABLE DRY RECREATIONAL SLIDE

CROSS-REFERENCE TO RELATED APPLICATIONS

The application claims priority to U.S. Provisional Application No. 63/262,969, which was filed Oct. 24, 2021, the entirety of which is hereby incorporated by reference.

BACKGROUND

The present disclosure relates to the field of dry recreational slides, and more particularly to portable dry recreational slides.

Recreational slides are longstanding popular attractions at playgrounds and for backyards. However, such slides typically are expensive, permanent structures that require steeply-sloped inclines in order for a user to slide thereon. Not only are such slide permanent installations, but because of the steep slope requirements it can be prohibitively expensive, and even dangerously high, to provide a slide with 10 or more feet of length. Bounce houses are portable inflatable structures that often incorporate slides. While technically portable, bounce houses typically are very heavy, requiring involvement by multiple adults in order to transport and set up the structure. Further, a source of electricity, when a plug-in outlet or a dedicated generator, is typically required. Like other dry slides, bounce houses also require steeply-sloped surfaces in order for users to readily slide with gravity, and thus must be very large in order to accommodate a slide of more than a few feet. Further, due to their size, bounces houses are only appropriate for placement only on certain types of terrain, such as relatively flat surfaces. Thus, bounce houses have important limitations in portability and location of use. Portable water slides made of elongated plastic sheeting flooded with water have proven popular and effective. However, in order for users to slide sufficiently upon the plastic sheeting, water and/or another medium (such as oils and soaps) must be used. Thus, portable water slides require access to a water source and/or other slide medium source, substantially limiting their portability. Also, user's must be willing to get wet in order to use the water slide, limiting their use to certain seasons and situations.

SUMMARY

The present disclosure discloses aspects of a portable dry recreational slide that can be readily used in a broad range of locations, can be truly portable, in that some embodiments can be readily carried by a single person or even a child, and provides a sliding experience of ten feet or more without requiring application of water or any other slide medium.

The present disclosure presents aspects and embodiments of a portable dry recreational slide that can be stored and transported in a compacted configuration that is small and lightweight enough to be carried by a single person and even a child. The dry slide is easily converted from the compacted configuration to a deployed configuration in which it defines an elongated slide body that conforms to the shape of the underlying support surface, be it a flat, inclined and/or undulating outdoor grass or dirt surface or a hard or carpeted indoor surface, and includes a low-friction surface that enable riders to slide thereon without addition of added, temporary lubricants such as water, oil, soap or the like. Further, the dry slide can be compacted to a small volume, such as to fit within a 15"×5" volume for a 3'×30' sliding surface.

The slide body is made of a low-friction textile, most preferably a woven textile substrate such as a woven nylon, polyester or polyethylene with a low friction coating such as a silicone coating. The coating defines the sliding surface upon which riders may slide, and preferably has a coefficient of friction of about 0.25 or less. Most preferably the dry slide includes one or more vehicles which participants can use to distribute weight and/or which include low-friction surfaces so as to enhance the sliding experience. Vehicles can include, for example, plastic vehicles that can distribute the weight of a rider sitting or otherwise disposed thereon, and can also include a low-friction surface. Vehicles can also be made of the same or similar material as used to make the slide body. Such a textile vehicle can include a front pouch in which a rider can place their feet or which can receive a front end of a secondary vehicle, such as an inflatable vehicle, so as to take advantage of the weight-distribution and comfort of the secondary vehicle but also provide the low-friction surface of the textile vehicle.

The textile of which the slide body is made preferably is light and flexible so as to be easily reconfigured from the deployed configuration to the compacted configuration. Most preferably the textile is sufficiently light in weight so that it can be compacted, such as by being rolled up, into a size that is easily manageable, and is 10 pounds or less in weight, and even more preferably 5 pounds or less in weight for a dry slide of about 30 feet. Furthermore, in order to enhance portability, carrying straps can be integrated into the dry slide and/or a carrying bag such as a dedicated backpack can be provided so as to maintain the dry slide apparatus, including all or most components, together in one kit for easy storage and transportation.

In accordance with one embodiment the present specification provides a portable dry recreational slide apparatus, comprising a slide body that is changeable from a compacted configuration to a deployed configuration. The slide body is configured so that when it is in the deployed configuration it has a longitudinal axis and is elongated along the longitudinal axis from a start end to a finish end. The slide body comprises a flexible textile substrate comprising a woven fabric and a friction-reducing coating deposited on the textile substrate. The friction-reducing coating has a coefficient of friction less than a coefficient of friction of the textile substrate. A carrying structure is integrally formed with the slide body. The carrying structure is configurated to be accessible when the slide body is in the compacted configuration.

In some such embodiments, the slide body has a thickness less than about 0.2 mm and a density of about 150 g/m^2 or less. In further variations, the slide body comprises a woven textile chosen from the group consisting of nylon, polyester and polyethylene. In still further variations, the friction-reducing coating comprises a silicone compound.

In some embodiments, the slide body has a length of at least 30 feet and a total weight less than 5 lb.

Some embodiments can be combined with a backpack defining a backpack space sized and configured to receive the slide body therewithin when the slide body is in the compacted configuration.

In further embodiments, a sliding surface is defined atop the friction-reducing coating, and the sliding surface has a dry coefficient of friction less than about 0.25. In further embodiments the sliding surface can have a dry coefficient of friction of about 0.21 or less.

Additional embodiments can also comprise a flexible woven textile substrate formed separately from the slide body and having a friction-reducing coating deposited on a bottom surface thereof so that the bottom surface has a dry coefficient of friction less than about 0.25. In some variations, the textile vehicle comprises a front pocket defining a front pocket space. Further variations can additionally comprise an elongated secondary vehicle having a front end configured to fit into the front pocket space of the textile vehicle and to at least partially support a rider thereon.

In yet additional embodiments, the slide body can comprise a plurality of spaced-apart anchor structures, and wherein adjacent ones of the anchor structures are configured to be attachable one to another so as to maintain the slide body in the compacted configuration.

In further embodiments, the slide body comprises a plurality of spaced-apart apertures disposed along an edge of the slide body, and the carrying structure comprises a carrying strap that is configured to fit through the spaced-apart apertures so as to maintain the slide body in the compacted configuration.

In accordance with another embodiment, the present specification discloses a portable dry recreational slide apparatus, comprising a slide body that is changeable from a compacted configuration to a deployed configuration. The slide body is configured so that when it is in the deployed configuration it has a longitudinal axis and is elongated along the longitudinal axis from a start end to a finish end. The slide body has a thickness less than about 0.2 mm and a density of about 150 g/m^2 or less. The slide body further comprises a flexible textile substrate comprising a woven or non-woven fabric chosen from the group consisting of nylon, polyester and polyethylene, and a friction-reducing coating deposited on the textile substrate. The friction-reducing coating comprises a silicone compound and having a dry coefficient of friction less than a coefficient of friction of the textile substrate and less than about 0.25.

In accordance with another embodiment, the present specification provides a method of storing and transporting a portable dry recreational slide apparatus that has an elongated slide body made up of a flexible woven fabric substrate having a low-friction coating deposited thereon. The method comprises folding the slide body about a fold line generally parallel to its longitudinal axis and engaging a plurality of first anchoring structures spaced apart on a first edge of the slide body with a plurality of second anchoring structures spaced apart on a second edge of the slide body. The slide body can be rolled from a distal end to a proximal end. A strap structure integrated with the proximal end of the slide body can be used to secure the slide body in a fully-rolled compacted configuration. The compacted slide body can be supported using a carry portion of the strap structure.

In another variation, the slide body defines a sliding surface having a dry coefficient of friction less than about 0.25. In a further variation the slide body has a weight density between about 90-150 g/m^2.

Yet another variation additionally comprises placing a textile vehicle comprising a flexible woven substrate having a low-friction coating deposited thereon onto the folded slide body and rolling the textile vehicle with the slide body.

A still further variation additionally comprises placing a flexible molded polymer-based vehicle onto the slide body and rolling the molded polymer-based vehicle with the slide body.

BRIEF DESCRIPTION OF THE DRAWINGS

FIG. 1 is a perspective view of an embodiment of a dry slide having features as discussed herein;

FIG. 2 is a cross-sectional view taken along lines 2-2 of FIG. 1;

FIG. 3 is a cutaway view taken along lines 3-3 of FIG. 1 and exploded;

DESCRIPTION

Figure 4:
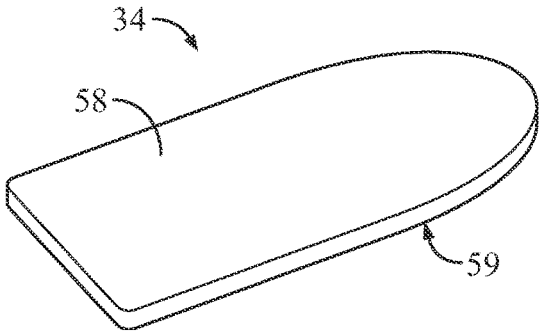
FIG. 4 is a perspective view of one embodiment of a ride vehicle.

The present disclosure presents aspects and embodiments of a portable dry recreational slide that can be stored and transported in a compacted configuration that is small and lightweight enough to be carried by a single person or even a child. The dry slide is easily converted from the compacted configuration to a deployed configuration in which it defines an elongated slide body that conforms to the shape of the underlying support surface, be it a flat, inclined and/or undulating outdoor grass surface or a hard or carpeted indoor surface.

The slide body is made of a low-friction textile, most preferably a textile substrate such as a woven nylon, woven polyester or non-woven polyethylene with a low friction coating such as a silicone coating. The coating defines the sliding surface upon which riders may slide, and preferably has a coefficient of friction of about 0.25 or less. Most preferably the dry slide includes one or more vehicles which participants can use to distribute weight and/or which include low-friction surfaces so as to enhance the sliding experience. Vehicles can include, for example, plastic vehicles that can distribute the weight of a rider sitting or otherwise disposed thereon, and can also include a low-friction surface. Vehicles can also be made of the same or similar material as used to make the slide body. Such a textile vehicle can include a front pouch in which a rider can place their feet or which can receive a front end of a secondary vehicle, such as an inflatable vehicle, so as to take advantage of the weight-distribution and comfort of the secondary vehicle but also provide the low-friction surface of the textile vehicle.

The textile of which the slide body is made preferably is light and flexible so as to be easily reconfigured from the deployed configuration to the compacted configuration. Most preferably the textile is sufficiently light in weight so that it can be compacted, such as by being rolled up, into a size that is easily manageable, and is 10 pounds or less in weight. Furthermore, in order to enhance portability, carrying straps can be integrated into the dry slide and/or a carrying bag such as a dedicated backpack can be provided.

With initial reference to FIG. 1, an embodiment of a dry slide 20 is depicted in a deployed configuration on an undulating hill. The dry slide 20 comprises an elongated slide body 22 that extends from a start, or proximal, end 24 to an exit, or distal, end 26. The slide body 22 defines a sliding surface 30 upon which a rider 32 can slide. Preferably, the sliding surface 30 is about 2-6 feet wide, more preferably about 3-5 feet wide, and has a length of 10 to 30 feet or longer. Of course, it is to be understood that any number of configurations, such as multiple side-by-side tracks defined on the sliding surface 30 to enable racing, can be used.

As shown in FIG. 1, the rider 32 can ride upon a vehicle 34. A plurality of anchoring structures 36 can be provided at or adjacent the proximal end 24, distal end 26 and/or midway along the length of the slide body 22. The anchoring structures 36 can comprise a durable material such as a canvas or the like, and can include grommets 38 defining an aperture or similar structure. Further anchoring structures, such as flat-top stakes 40, elongated straps 42, or the like, can be attached at the grommets 38 to maintain the position of the dry slide 20 as desired. In the illustrated embodiment, the anchoring structures 36 extend outwardly in a direction away from the longitudinal axis of the slide body 22, further than does an edge of the sliding surface 30. As such, anchoring structures are anticipated to not interfere with riders on the sliding surface 30. Of course, in additional embodiments anchoring structures can be inwardly of outer side edges of the sliding surface 30.

In the illustrated embodiment, the dry slide 20 is deployed in an outdoors configuration, such as on a grassy hill, and stakes 40 help secure the dry slide 20 in place. In other situations, the dry slide 20 may be deployed indoors such as on a carpet or hard floor, in which deployment of stakes 40 is not an option. In such a situation, elongated straps 42 can be extended through the grommets 38 and can attach to furnishings or other structure so as to help hold the dry slide 20 in place. It is to be understood also that the dry slide 20 can be used without any anchoring structure.

Continuing with reference to FIG. 1, a proximal reinforcement 44 can be provided along the proximal end 24 of the slide body 22 and can comprise and support the anchoring structures 36. The proximal reinforcement 44 can help provide and maintain sturdy support to maintain the slide body 22 in a desired position during use. In the illustrated embodiment, a carrying strap 50 is attached or integrated into the proximal reinforcement 44. The illustrated carrying strap 50 comprises a loop large enough to fit over a user's shoulder to facilitate carrying of the dry slide 20 when in a compacted configuration, as will be discussed in more detail below.

With reference next to FIGS. 2 and 3, the slide body 22 can be formed of multiple layers. In the illustrated embodiment, a substrate layer 52 is a thin polymer-based layer that is flexible, durable and resistant to tearing. A low-friction coating 54 preferably is applied to the substrate layer 52, and defines the sliding surface 30. Preferably, the low-friction coating 54 has a static coefficient of friction less than about 0.30, more preferably less than about 0.25, and even more preferably about 0.21 or less. In the illustrated embodiment, a coating 54 is applied to both the top and bottom surfaces of the substrate 52. Additional embodiments may coat only the top surface. And still further embodiments may apply a high-friction coating to the bottom surface of the substrate 52.

In a preferred embodiment, the substrate comprises a textile, such as a woven textile formed of nylon or polyester fully drawn yarn 56 woven in various weaves, such as an oxford weave. The nylon or polyester textile preferably is about 0.1 mm-0.2 mm in thickness, thus providing weight reduction and cost reduction while maintaining toughness, strength and performance. The coating 54 can be applied to the woven textile, such as by an atomized spray, forming a low-friction layer. In a preferred embodiment, the coating 54 comprises a silicone compound solution having a thickness of about 0.009-0.013 mm, and more preferably about 0.011 mm. In additional embodiments, the fully drawn yarns 56 can be coated with a low-friction silicone coating prior to being woven. Another suitable substrate 52 can comprise a non-woven polyethylene blend of about 85% or more medium weight polyethylene (density of at least about 0.935 g/cm^3) and a thickness of about 0.030-0.07 mm, also coated with a silicone. Most preferably, the slide body 22 material has a weight of about 90-150 g/m^2. As such, the total weight of a slide body 22 about 4 feet wide and 30 feet long can be expected to be less than about 2.5-5 lb.

It is to be understood that other materials may be available, or may become available, that may be operative but may have other negative aspects. For example, high-density polyethylene, PTFE (Teflon) and fluorinated polymers may exhibit low friction, but can be unsuitable due to excessive weight and/or high cost.

With reference next to FIG. 4, one embodiment of a ride vehicle 34 can comprise a molded polymer that is generally flat and comprises an upper surface 58 upon which a rider can sit, kneel, lay or the like. A bottom surface 59 can be coated with a low-friction coating. Even if not so coated, however, the molded polymer preferably is sufficiently stiff and thick to distribute a rider's weight so as to minimize the frictional drag as the rider 32 slides along the sliding surface 30.

Figure 5:
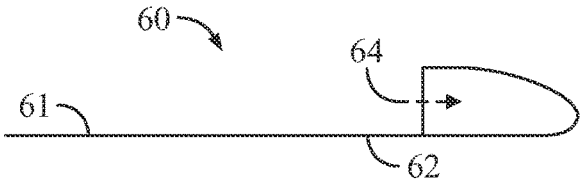
FIG. 5 is a side view of an embodiment of a textile vehicle.

With reference next to FIG. 5, a textile vehicle 60 can comprise a body 61 formed of a textile that is the same or similar to the slide body 22. As such, a bottom surface 62 of the textile vehicle 60 comprises a low-friction coating 54. When a rider uses the textile vehicle 60, the low-friction bottom surface 62 of the textile vehicle 60 slides over the low-friction slide surface 30, providing enhanced sliding performance. In the illustrated embodiment, a front portion of the textile vehicle body 61 is folded backwardly and sewn or otherwise attached to itself so as to form a front pocket 64. In use, a rider can place feet, hands, or the like within the front pocket 64 during sliding.

Figure 7:
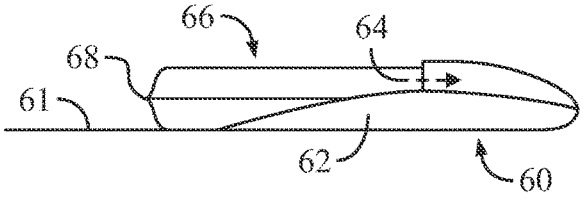
FIG. 7 shows the textile vehicle and ride vehicle of FIG. 6 assembled together.
Figure 6:
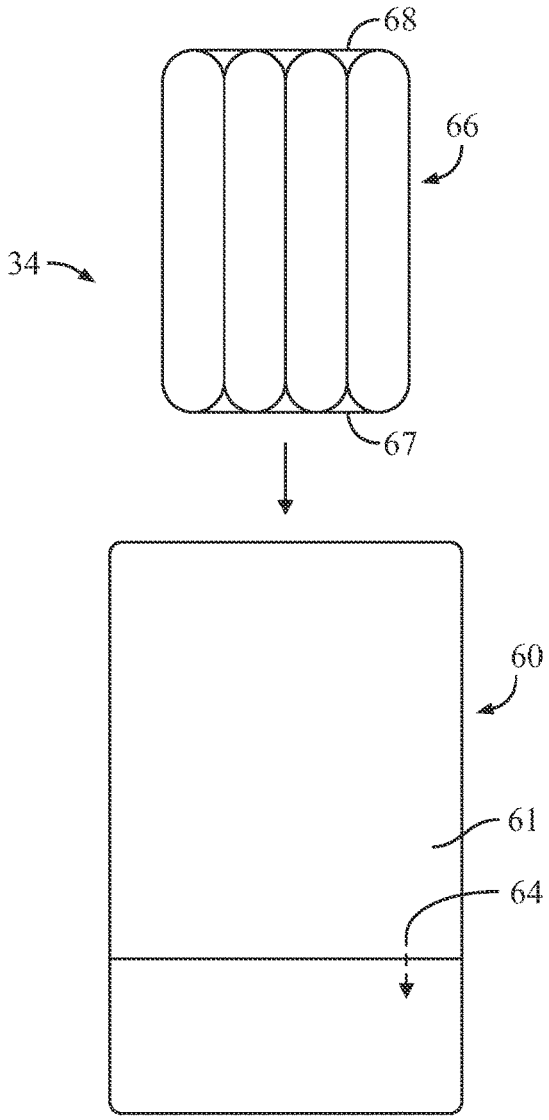
FIG. 6 shows the textile vehicle of FIG. 5 in combination with another embodiment of a ride vehicle.

With additional reference to FIGS. 6 and 7, another embodiment of a ride vehicle 34 can comprise an inflatable body 66 having a front end 67 and a back end 68. In some variations the inflatable body 66 can have a low-friction coating, such as a silicone coating 54, applied to one or both of its bottom and top surfaces. In other variations, the inflatable body 66 may not have any friction-reducing structure, but the front end 67 can be sized and configured to fit within the front pocket 64 of the textile vehicle 60. Thus, the inflatable body 66 can take advantage of the low-friction coating 54 of the textile vehicle 60, providing excellent sliding performance while also providing increased comfort (due to its inflated nature) and weight distribution for the rider. Preferably a length of the inflatable body 66 is less than a length of the textile vehicle body 61 so that the entire inflatable body 66 can take advantage of the low-friction bottom surface 62 of the textile vehicle 60.

It is to be understood that other types and sizes of ride vehicles can be employed. For example, foam bodyboards can be used on their own or in conjunction with a textile vehicle 60. Additional materials that are not necessarily dedicated for use with the dry-slide 20 can also be used. For example, a user may procure cardboard for use as a ride vehicle, either on its own or in conjunction with a textile vehicle 60. Some suitable ride vehicles may include boards having bottom surfaces made of high density plastics such as Surlyn® or high density polyethylene, stiff or flexible, can also be used with the dry slide 20. Further, riders can enhance their sliding experience by wearing low-friction clothing, such as clothing having components or portions made with nylon, spandex, polyester with or without fluorocarbon-based durable water repellent (DWR) or silicone coating. Such clothing can include, for example, shoes, socks, gloves, pants and knee pads.

Multiple dry slides 20 can be combined to form an extra-long dry slide. For example, the proximal end 24 of a second dry slide can be positioned—and preferably anchored—just proximal of the distal end 26 of a first dry slide 20 so that the distal end of the first dry slide 20 overlaps on top of and over the proximal end 24 of the second dry slide. As such, a rider sliding the length of the first dry slide 20 will be deposited onto the second dry slide 20, enabling continued sliding along the second dry slide. Such an arrangement preferably will cover the proximal reinforcement 44 of the second dry slide underneath the first dry slide so that it will not affect the rider's progress.

Figure 8:
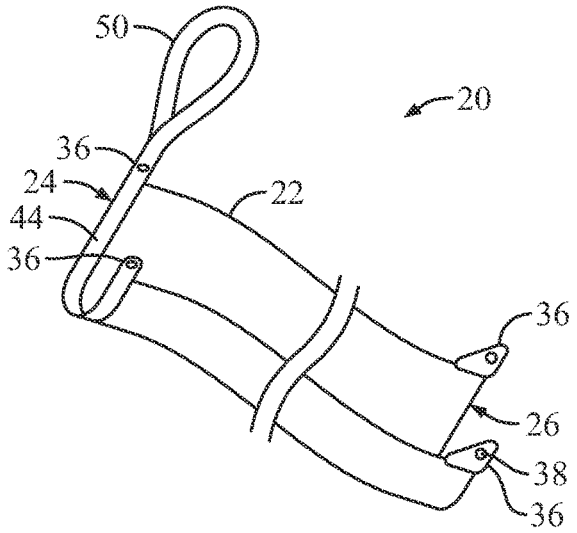
FIG. 8 shows the dry slide of FIG. 1 being folded about a longitudinal fold line.
Figure 9:
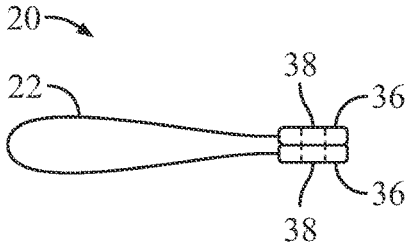
FIG. 9 shows the arrangement of FIG. 9 viewed from a distal end.
Figure 10:
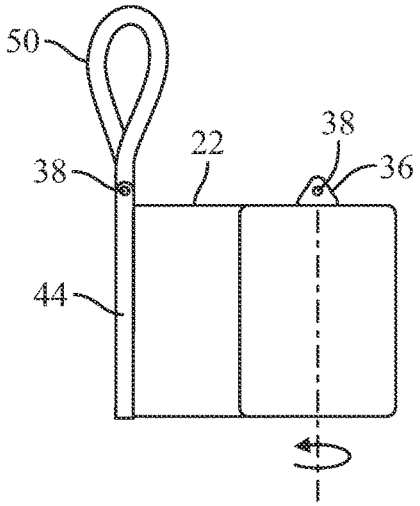
FIG. 10 shows the arrangement of FIG. 9 partially compacted.
Figure 11:
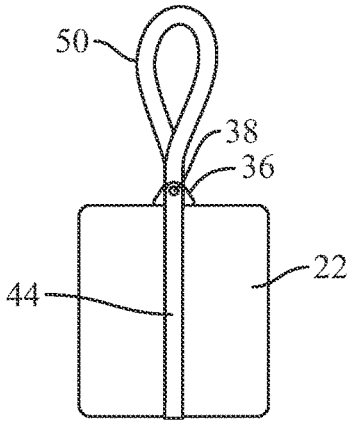
FIG. 11 shows the dry slide of FIG. 8 fully compacted.

With reference next to FIG. 8, when use of the dry slide 20 is complete, the user can reconfigure it from its deployed configuration (as in FIG. 1) to a compacted configuration (such as in FIG. 11). In the illustrated embodiment, breakdown of the dry slide 20 can comprise folding the slide body 22 along its longitudinal axis so that opposing anchoring structure 36 are aligned. As shown in FIG. 9, in some embodiments the grommets 38 or other portion of the anchoring structures 36 can comprise a fastener, such as a snapping fastener, so that the opposing anchoring structures 36 are held together, such as with an audible "snap". In another variation, an elongated strap 42 can, instead, be advanced through aligned grommets 38 of the anchoring structures 36. Continuing with reference to FIGS. 10 and 11, the folded slide body 22 can then be rolled up, starting at the distal end 26 and moving toward the proximal end 24. During the rolling process, further connection or engagement with other anchoring structures 36 can take place mid way through the rolling/compaction process. Eventually, when rolling is complete, the anchoring structure 36 from the distal end 26 can be linked to the anchoring structure 36 from the proximal end 24, such as through a "snap"-type fastener. In embodiments in which the anchoring structure 36 extends outwardly from the sliding surface 30, the distal anchoring structure 36 and other anchoring structures will be accessible for connection to the proximal anchoring structure 36 notwithstanding the slide body 22 being tightly rolled up.

Figure 12:
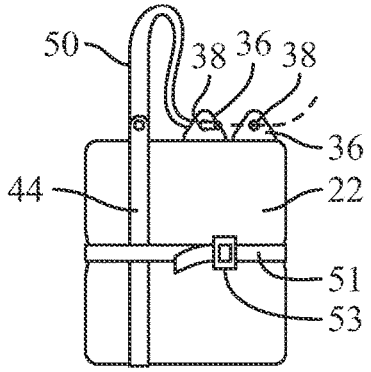
FIG. 12 shows another embodiment of a dry slide as in FIG. 8 fully compacted.

FIG. 12 shows an embodiment in which, after the slide body 22 is rolled up, the carry strap 50 can be advanced through the grommets 38 of the anchoring structures 36. In this manner, the compacted dry slide 20 is supported by the carrying strap 50, and thus the carrying strap 50 supports the compacted slide body 22 at multiple locations along its length. Not only is the carrying strap 50 capable of enabling a user to easily carry the dry slide 20, but since the slide body 22 is supported at multiple locations along its length, it is likely to retain its compacted structure and not partially or fully unwind while being carried. FIG. 12 also show an optional secondary strap 51 that is configured to fit about a circumference of the rolled slide body 22 and can be secured with a secondary strap buckle 53. Other circumferential securement structures, including structures that can be integrated with the carrying strap 50, can also be employed as desired.

Figure 13:
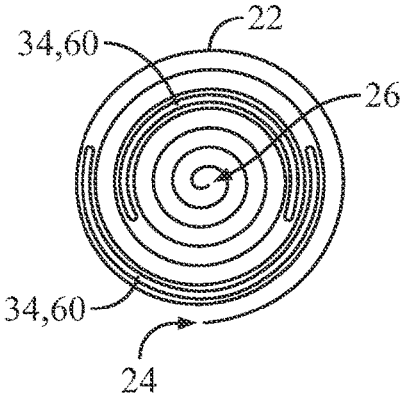
FIG. 13 is a top view of an embodiment of a dry slide rolled up with ride vehicles rolled up with the dry slide.

With reference next to FIG. 13, in some embodiments, the vehicles 34, 60 can be rolled up/compacted with the slide body 22 so that the dry slide 20, including components, can be carried all at once. In embodiments in which a textile vehicle 60 is provided, the textile vehicle body 61 will easily fit within and be rolled up with the rest of the slide body 22. If an inflatable body 66 is employed, it should first be uninflated. Preferably, the material that from which the inflatable body 66 is made is flexible and easily included into the compacted dry slide 20. In embodiments in which the vehicle 34 is a molded piece of plastic, preferably the plastic is selected, and a thickness of such plastic is selected, so that the vehicle can be elastically bent in a manner to accommodate compaction, such as being rolled up with the slide body 22. Otherwise, preferably the vehicle 34 itself comprises an aperture through which the carrying strap 50 can be advanced so that the slide body 22 and vehicles 34 can all be carried together. Additionally, a supplemental bag (not shown) can be supplied for items such as stakes 40, which bag can also be looped over the carrying strap 50.

Figure 14:
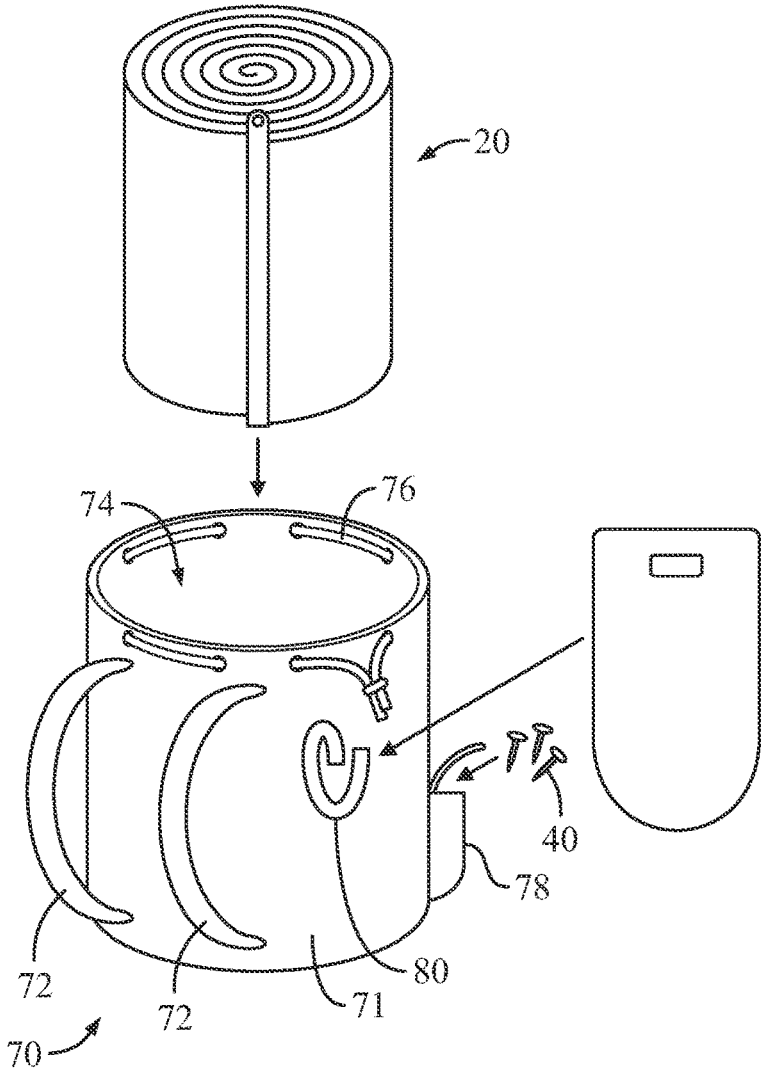
FIG. 14 is a perspective view of a dry slide system comprising a backpack for receiving and storing a compacted dry slide and simultaneously holding other components for use with the dry slide.

With reference next to FIG. 14, in another embodiment a backpack 70 can have a backpack body 71 to which a pair of shoulder straps 72 are attached. An opening 74 can be provided to enable access to a storage space defined within the backpack body 71. A compacted dry slide 20 can be advanced through the opening 74 into the backpack storage space and enclosed therewithin with a closure 76. A secondary pocket 78 can be provided for components such as stakes 74, and secondary connector(s) 80, such as a snap-closing or Velcro-closing strap 80 can be provided to attach to other vehicles 34. As such, the entire dry slide 20 and related components can be carried/transported/stored together.

In embodiments discussed above, compacting the dry slide 20 to the compacted configuration has involved rolling up the slide from the distal end 26 to the proximal end 24. It is to be understood that, in additional embodiments, such rolling can take place without first folding the slide body 22 along a longitudinally-extending fold line, or may include multiple such folds. Also, in some variations the slide body 22 can be folded in multiple different directions rather than being rolled. In still further variations, the slide body 22 can be stuffed into a bag such as the backpack 70 without regard to rolling or folding, as with a sleeping bag.

In another embodiment, a slide body 22 can be configured for use with another dry sliding structure such as, for example, a bounce house having a slide. A slide body 22 comprising the materials discussed herein and having the low friction properties which can be selectively attached (such as via straps 42 extending through grommets 38) and detached from a slide surface of the bounce house, and particularly combined with a textile vehicle 60, can provide an improved and exciting sliding experience for the rider.

The embodiments discussed above have disclosed structures with substantial specificity. This has provided a good context for disclosing and discussing inventive subject matter. However, it is to be understood that other embodiments may employ different specific structural shapes and interactions.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, but should be determined only by a fair reading of the claims that follow.

What is claimed is:

1. A portable dry recreational slide apparatus, comprising:

a slide body that is changeable from a compacted configuration to a deployed configuration, the slide body configured so that when it is in the deployed configuration it has a longitudinal axis and is elongated along the longitudinal axis from a start end to a finish end, the slide body having a thickness less than about 0.2 mm and a density of about 150 g/m^2 or less, the slide body comprising:

a flexible textile substrate comprising a woven or non-woven fabric; and a friction-reducing coating deposited on the textile substrate, the friction-reducing coating having a coefficient of friction less than a coefficient of friction of the textile substrate, a sliding surface being defined atop the friction-reducing coating, and the sliding surface has a dry coefficient of friction less than about 0.25; and a carrying structure integrally formed with the slide body;

wherein the carrying structure is configurated to be accessible when the slide body is in the compacted configuration, wherein the slide body comprises a plurality of spaced-apart apertures disposed along an edge of the slide body, and wherein the carrying structure comprises a carrying strap that is configured to fit through the spaced-apart apertures so as to maintain the slide body in the compacted configuration.

2. The portable dry recreational slide apparatus of claim 1, wherein the slide body comprises a woven or non-woven textile chosen from the group consisting of nylon, polyester and polyethylene.

3. The portable dry recreational slide apparatus of claim 2, wherein the friction-reducing coating comprises a silicone compound.

4. The portable dry recreational slide apparatus of claim 3, wherein the slide body has a length of at least 30 feet and a total weight less than 5 lb.

5. The portable dry recreational slide apparatus of claim 4, in combination with a backpack defining a backpack space sized and configured to receive the slide body therewithin when the slide body is in the compacted configuration.

6. The portable dry recreational slide apparatus of claim 1, wherein the sliding surface has a dry coefficient of friction of about 0.21 or less.

7. The portable dry recreational slide apparatus of claim 1, comprising a textile vehicle comprising a flexible woven or non-woven textile substrate having a top surface and a bottom surface opposite the top surface, the non-woven textile substrate having a friction-reducing coating deposited on the bottom surface thereof so that the bottom surface has a dry coefficient of friction less than about 0.25.

8. The portable dry recreational slide apparatus of claim 7, wherein the textile vehicle comprises a front pocket defining a front pocket space.

9. The portable dry recreational slide apparatus of claim 8 additionally comprising an elongated secondary vehicle having a front end configured to fit into the front pocket space of the textile vehicle and to at least partially support a rider thereon.

10. A portable dry recreational slide apparatus, comprising:

a slide body that is changeable from a compacted configuration to a deployed configuration, the slide body configured so that when it is in the deployed configuration it has a longitudinal axis and is elongated along the longitudinal axis from a start end to a finish end, the slide body comprising:

a flexible textile substrate comprising a woven or non-woven fabric; and a friction-reducing coating deposited on the textile substrate, the friction-reducing coating having a coefficient of friction less than a coefficient of friction of the textile substrate, a sliding surface being defined atop the friction-reducing coating;

a plurality of spaced-apart anchor structures; and a carrying structure integrally formed with the slide body;

wherein the carrying structure is configurated to be accessible when the slide body is in the compacted configuration, and wherein adjacent ones of the anchor structures are configured to be attachable one to another so as to maintain the slide body in the compacted configuration.

11. The portable dry recreational slide apparatus of claim 10, wherein the slide body comprises a plurality of spaced-apart apertures disposed along an edge of the slide body, and wherein the carrying structure comprises a carrying strap that is configured to fit through the spaced-apart apertures so as to maintain the slide body in the compacted configuration.

12. A method of storing and transporting a portable dry recreational slide apparatus that has an elongated slide body made up of a flexible woven or non-woven fabric substrate having a low-friction coating deposited thereon, comprising:

folding the slide body about a fold line generally parallel to its longitudinal axis and engaging a plurality of first anchoring structures spaced apart on a first edge of the slide body with a plurality of second anchoring structures spaced apart on a second edge of the slide body;

rolling the slide body from a distal end to a proximal end, rolling comprising placing a flexible molded polymer-based vehicle onto the slide body and rolling the molded polymer-based vehicle with the slide body;

using a strap structure integrated with the proximal end of the slide body to secure the slide body in a fully-rolled compacted configuration; and supporting the compacted slide body using a carry portion of the strap structure.

13. The method of claim 12, wherein the slide body defines a sliding surface having a dry coefficient of friction less than about 0.25.

14. The method of claim 13, wherein the slide body has a weight density between about 90-150 g/m^2.

15. The method of claim 12, additionally comprising placing a textile vehicle comprising a flexible woven substrate having a low-friction coating deposited thereon onto the folded slide body and rolling the textile vehicle with the slide body.

16. The apparatus of claim 11, wherein the slide body having a thickness less than about 0.2 mm and a density of about 150 g/m^2 or less, and the sliding surface has a dry coefficient of friction less than about 0.25.

* * * * *